United States Patent [19]

Munk et al.

[11] 4,167,232

[45] Sep. 11, 1979

[54] BOX COMPOSED OF PRESSED MATERIALS FOR SHIPPING FRUITS, VEGETABLES

[75] Inventors: Edmund Munk; Gerd Weinberg; Hermann Henke, all of Oberstenfeld, Fed. Rep. of Germany

[73] Assignee: J. F. Werz Jr. KG Werzalit-Prssholzwerk, Oberstenfeld, Fed. Rep. of Germany

[21] Appl. No.: 830,445

[22] Filed: Sep. 6, 1977

[51] Int. Cl.[2] ..... B65D 21/02

[52] U.S. Cl. ..... 206/509; 206/512; 220/4 F

[58] Field of Search ..... 206/509, 511, 512; 229/23 R; 220/4 F; 217/15, 12 R, 43 R, 48

[56] References Cited

U.S. PATENT DOCUMENTS

| | | | |
|---|---|---|---|
| 1,883,553 | 10/1932 | Chain | 220/4 F |
| 3,259,269 | 7/1966 | Asenbauer | 206/509 |
| 3,303,965 | 2/1967 | Parker et al. | 206/512 |
| 3,327,896 | 6/1967 | Asenbauer | 206/509 |
| 3,572,535 | 3/1971 | Kinzie | 220/4 F |
| 3,675,808 | 7/1972 | Brink | 206/509 X |
| 3,904,066 | 9/1975 | Wilson | 206/512 X |

*Primary Examiner*—Davis T. Moorhead
*Attorney, Agent, or Firm*—Michael J. Striker

[57] ABSTRACT

A box for shipping fruits, vegetables, etc. is composed of

[a] two pairs of substantially square or rectangular generally flat side panels of generally equal shape;

[b] the longitudinally upper edges of the panels being turned outwardly and the longitudinal lower edges being turned inwardly so as to mesh with each other upon storage of the boxes in piles,

[c] abutting corner sections of each panel being turned outwardly at an obtuse angle along most of their vertical length, the upper ends of the corner portions thus forming an enlarged base when the boxes are piled up upon each other, and

[d] a continuous straight channel extending parallel to and above the lower edges of the box adapted to receive a bottom member.

10 Claims, 3 Drawing Figures

BOX COMPOSED OF PRESSED MATERIALS FOR SHIPPING FRUITS, VEGETABLES

BACKGROUND OF THE INVENTION

The invention relates to a box of pressed materials for shipping fruits, vegetables, etc. which is intended for one use only and is therefore disposable and is adapted for storage in piles.

Disposable boxes have found increasing use as one-time packaging for shipping fruits, vegetables, etc. These boxes are then destroyed at the point of destination. It is important in these cases that the cost of the packaging constitute as low a fraction of the packed goods as possible and that their destruction does not interfere with the environment and does not result in large amounts of waste. This is for instance accomplished by burning the material when they reach their final destination.

In spite of these requirements the boxes must have a strength that the goods which usually are of a delicate nature are adequately protected. The box must furthermore not absorb humidity either from its contents or from the exterior atmosphere since this would affect the strength of the packaging material which in that case may disintegrate during shipment and may cause loss of the contents.

Disposable boxs have become known, for instance from the German published application No. 1,586,642 which shows boxes which are made of single thin panels of which each is connected with the next panel and which when opened up are in one plane and are made in single pieces from a mixture of lignocellulose chips or fibers and a curable binding agent.

This box of the prior art has proved quite useful for a number of applications. However, the manufacture of this box is still too costly for some used and the thus-formed product is therefore too expensive in a number of cases of use.

The object of the present invention therefore is a box which can be made in an inexpensive way from single parts without affecting the quality of the product. Besides, the individual boxes must be adapted to be arranged in piles so that they make the best use of available space during shipment and reduce the transportion costs. It is also necessary that they can be assembled in a simple way at the place where they are used.

The box moreover must be form stable to permit stapling in piles of large numbers of boxes. This involves the further requirement that the boxes must be formed so that when stored in piles upon each other they are not subject to shifting.

SUMMARY OF THE INVENTION

This object is solved by a box composed of pressed parts which comprises

[a] two pairs of substantially square or rectangular generally flat side panels of generally similar shape;

[b] the longitudinal upper edges of the panels being turned outwardly and the longitudinal lower edges being turned inwardly so as to mesh with each other upon storage of the boxes in piles,

[c] corner sections of each panel being turned outwardly at an obtuse angle along most of their vertical length, the upper ends of the corner portions thus forming an enlarged base when the boxes are piled up upon each other, and

[d] a continuous straight channel extending parallel to and above the lower edges of the box adapted to receive a bottom member.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF THE PREFERRED EMBODIMENTS

Figure 1:
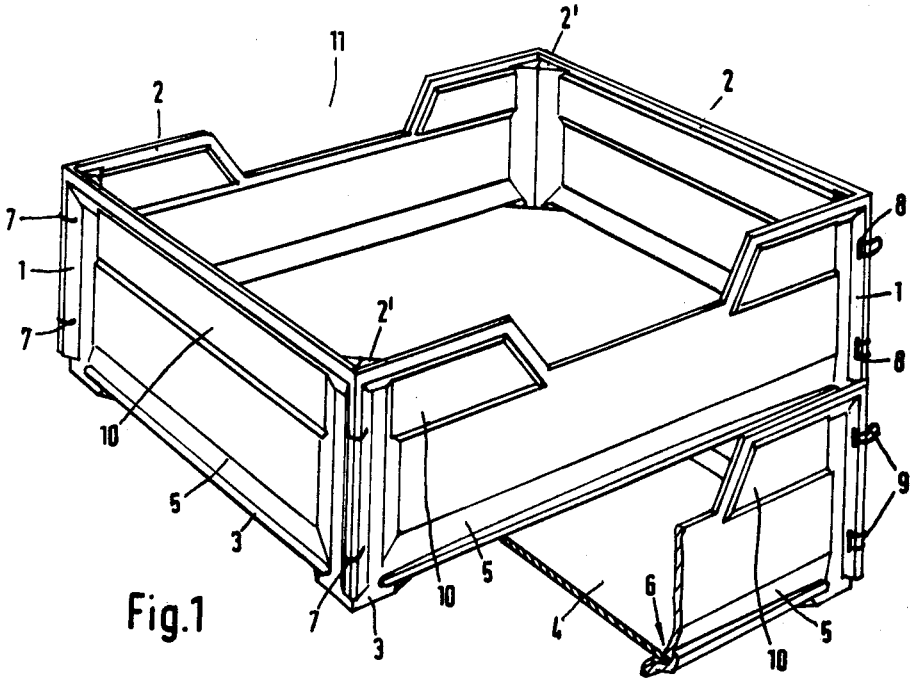
FIG. 1 shows the box of the invention in a perspective view together with a part view of another box of the same type, the two boxes being piled up upon each other.

As appears with particular reference to FIG. 1 the frame of the box consists of essential equal panels which, in the assembled box, are connected with each other at their corners, and which are adapted to receive the bottom of the box. The corner portions 1 of the box frame are bent outwardly. This permits to improve the stiffness of the box which thus can withstand comparatively high compression stresses at the corner portions which will receive these stresses during piling up of the boxes. This is made possible without increasing the strength or thickness of the panels. Thus, a comparatively large number of boxes can be arranged in piles.

Figure 2:
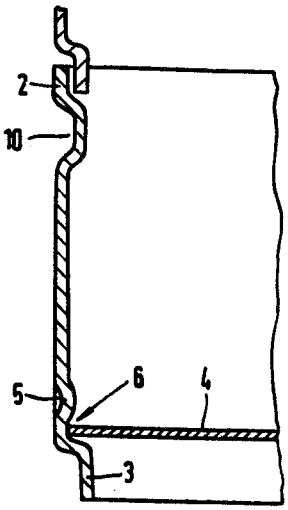
FIG. 2 shows a longitudinal section through a part of the adjoining portions of the two boxes.

The panels in addition at their upper edge are provided with a rim 2 which, as appears particularly from FIG. 2, cooperates with the inwardly bent lower edge portion 3. Thus, a closed interlocking connection of the boxes is possible when arranging them in piles without danger of slipping of the boxes against each other. The rim portion 2 is provided with an enlarged base portion 2' at the corner sections.

The form of lower edge as described also permits a simple and secure form of holding the bottom floor of the box. Between the inwardly offset lower edge 3 and a bent portion 5 which acts as a stiffening element and extends parallel to the lower edge, a channel 6 is formed into which the box bottom 4 can be placed or snapped in to provide a secure interlock.

Figure 3:
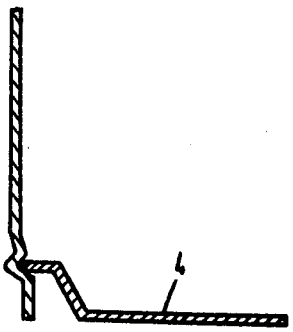
FIG. 3 is a partial longitudinal section through part of the box illustrating another embodiment for receiving the bottom member.

The bottom member 4 normally is formed as a flat sheet or plate, for instance of pressed wood or fiberboard. The bottom floor can also be formed to provide a box-shaped receiving space as more clearly shown in FIG. 3. This embodiment is of particular advantage if the boxes are moved on conveyor lines consisting of rollers.

The box of the invention is particularly suited to be shipped in disassembled manner without requiring much space so that it is assembed only at the place of first use. In this case the individual panels and the bottom are shipped in a pile and are assembled later by connecting the panels at the corners by means of metal clips.

It will, however, be understood that the box frames can also be assembled ahead of the final use and can then be stored in piles by connecting three of the four corners with wire clips 7 whereby the frame of the box which is still open at one corner portion can be placed flat on a flat support. The corner portions at the fourth edge are provided with slots 8 through which metal clips or wire staples may be inserted during final assembly of the box frame.

The individual panels of the frame also have a sufficient stiffness and strength because a bent portion serving as bracing member 10 is provided near their upper edge.

As shown in FIG. 1 the panels may be provided at their upper edges with an intermediate recess 11 which permits easy handling of the boxes during storage and removal from storage. These recesses also permit an airing of the contents which may make additional airing apertures unnecessary.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A box composed of individual pressed material parts and suited for shipping of fruits, vegetables, etc. and adapted for stacking, said box comprising two pairs of substantially flat panels of generally equal shape; a bottom wall member of the box; and longitudinal upper edges of the panels being turned outwardly and then upwardly to form an upper shoulder which is outwardly bounded by the upwardly turned portion of the respective upper edges, and longitudinal lower edges being turned inwardly and downwardly so as to form a lower shoulder adapted to support said bottom wall member of the box, the downwardly turned portion of the respective lower edge of an upper box in a stack being receivable within the confines of the upwardly turned portions of the upper edges of a lower box in the stack and to rest on said upper shoulder of the same.

2. A box as defined in claim 1, wherein said side panels have substantially square shape.

3. A box as defined in claim 2, further comprising a continuous straight channel extending parallel to and above the lower edges of the box and adapted to receive said bottom member of the box.

4. The box of claim 1 wherein the box panels consist of a press-mass of a mixture of lignocellulose fibers and a cured binding agent.

5. The box of claim 3 which includes a bottom closely fitting with its outer edges into the said channel so as to form the bottom member of the box.

6. The box of claim 4 wherein the bottom has upturned and then outwardly directed edge portions which fit into said channel so as to form a bowl-shaped receiving vessel constituted by the said bottom.

7. The box of claim 1 wherein the panels include bent portions forming bracing elements extending parallel to the upper edges of the panels.

8. The box of claim 1 wherein the panels include bent portions forming a stiffening strip disposed parallel to and spaced from the inwardly turned lower edges, the said bent portions and lower edges forming an intermediate channel for receiving said bottom member.

9. The box of claim 1 wherein slots are provided in at least one pair of said panels at their adjoining corner portions for receiving fastening elements.

10. A box composed of individual pressed material parts and suited for shipping of fruits, vegetables, etc. and adapted for stacking, said box comprising two pairs of panels; a bottom wall member of the box; longitudinal lower edges of the panels being turned inwardly and downwardly so as to form a shoulder which is inwardly bounded by the downwardly turned portion of the respective lower edge; and abutting corner sections of each panel being turned inwardly at an obtuse angle along most of their vertical length, each of said corner sections having an upper and located substantially below the upper end of said panels, said upper ends of the corner sections thus forming an enlarged base for said shoulder of an upper box in a stack which is receivable within the confines of the upper ends of a lower box in the stack.

* * * * *